US005988100A

United States Patent [19]

Schmitt

[11] Patent Number: 5,988,100

[45] Date of Patent: Nov. 23, 1999

[54] APPARATUS FOR SUPPORTING AND ILLUMINATING DISPLAY FLAGS

[76] Inventor: Larry Schmitt, 14068 Linden Rd., Grass Valley, Calif. 95945

[21] Appl. No.: 08/960,849

[22] Filed: Oct. 30, 1997

[51] Int. Cl.[6] ..... G09F 17/00

[52] U.S. Cl. ..... 116/173; 362/431; 362/223

[58] Field of Search ..... 362/223, 253, 362/431; 116/173

[56] References Cited

U.S. PATENT DOCUMENTS

| | | | |
|---|---|---|---|
| 1,171,917 | 2/1916 | Axford | 116/173 |
| 1,256,232 | 2/1918 | Howard | 116/173 |
| 1,258,022 | 3/1918 | Kray . | |
| 1,660,341 | 2/1928 | Lapworth . | |
| 1,878,447 | 9/1932 | Sutphen . | |
| 3,323,486 | 6/1967 | Woolf | 116/173 |
| 3,752,975 | 8/1973 | Meyer . | |
| 3,890,497 | 6/1975 | Rush . | |
| 4,079,555 | 3/1978 | Barnes . | |
| 4,791,878 | 12/1988 | Lewis | 116/173 |
| 5,101,329 | 3/1992 | Doyle | 362/431 |

FOREIGN PATENT DOCUMENTS

WO 87/01755 3/1987 WIPO .

*Primary Examiner*—Nimeshkumar D. Patel
*Assistant Examiner*—Todd Reed Hopper
*Attorney, Agent, or Firm*—John P. O'Banion

[57] ABSTRACT

An internally lighted flag mast that reflects light externally using reflective surfaces within the flag mast to illuminate a flag hanging therefrom. An opaque cover, sides and baffles on the flag mast block direct light from being emitted and only allow reflected light to illuminate the flag. During darkness, a photosensor means automatically activates the light source.

24 Claims, 9 Drawing Sheets

APPARATUS FOR SUPPORTING AND ILLUMINATING DISPLAY FLAGS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains generally to flag poles and devices for illuminating flags attached thereto, and more particularly to an apparatus for supporting and illuminating a display flag which uses reflected light from an internal light source to illuminate a flag hanging therefrom.

2. Description of the Background Art

In the past, flags being flown from flag poles during periods of darkness have been illuminated using projection lights positioned near the base of the flag pole, or in some instances by an illumination source that was positioned atop the flag pole above the flag. Such methods of flag illumination have been found to be generally ineffective, however, because the illumination source remains stationary while the orientation of the flag can vary with changes in wind direction and strength. When this occurs, either all or part of the flag's surface may not be exposed to the light rays, thus resulting in either all or part of the flag remaining in darkness.

To solve this problem, lights have been mounted vertically along the flag pole adjacent the flag. One approach is to mount the lights vertically on a rotatable section at the upper end of the flag pole where the flag is attached. That approach would allow the lights to change direction along with changes in direction of the flag due to the wind. Another approach is to configure the lights to shine directly outward 360°, thus illuminating the flag at any direction.

Even though illuminated flag poles are well known, previously developed approaches to illuminating flags contain several deficiencies. First, the flag is attached along its side vertically to the flag pole. This leaves the flag dangling downward when there is insufficient wind to fly the flag, thus rendering a substantial portion of the flag non-visible, even with illumination. Second, even when increasingly popular display flags supported along their top edge are flown, the direct light used to illuminate the flag can produce an annoying glare for those viewing the flag and, in some instances, the glare can impact persons not even directly viewing the flag. Illuminated flag poles that use reflected light scatter light as they are shown or can only produce light in a directional flood, both of which result in the annoying glare.

Accordingly, there exists a need for an apparatus which can support and provide complete illumination of a flag without the drawbacks associated with light glare and scattered light from the illumination source, and for a flag pole capable of flying a flag such that a substantial portion of the flag's surface is continuously displayed irregardless of wind direction or strength. The present invention satisfies those needs, as well as others, and overcomes the deficiencies in prior approaches to supporting and illuminating flags.

BRIEF SUMMARY OF THE INVENTION

The present invention generally pertains to an internally lighted flag mast which uses only reflected light to illuminate a flag hanging therefrom horizontally along the mast.

By way of example, and not of limitation, the invention generally comprises an elongated flag mast having internal lighting means, internal reflectors and internal baffles. The flag mast includes a cover portion which extends for almost the entire length of the flag mast, beneath which the internal lighting means is enclosed. The cover portion extends outward forming sides which surround the top and sides of the lighting means as the sides curve downward near the edges. The internal baffles are attached beneath the lighting means. The combination of the cover, sides and baffles prevent direct light from shining outwards from the mast except in selected directions. Reflectors within the sides serve to reflect light in a downwardly direction from the flag mast onto a flag hanging horizontally or vertically therefrom.

The flag mast also includes a light sensor located within a cap at one end of the flag mast, which automatically activates the lighting means at the onset of darkness. The lighting means is preferably powered by an external voltage source which sends electricity through wires routed through a supporting flagpole and into the flag mast. Alternatively, a plurality of photovoltaic cells can be arranged atop the cover, in which case the lighting means would be powered by a rechargeable battery that recharges itself using energy from sunlight captured by the photovoltaic cells. The lighting means can comprise any conventional light source, including fiber optics, incandescent lights, fluorescent lights, conventional optical fibers and the like.

The flag mast can be supported by a vertical flagpole or other means that supports the flag mast in a horizontal orientation. When a vertical flag pole is used, the flag mast is preferably attached using a gimbal or collar that allows vertical and rotational movement of the flag mast. The flag is raised and lowered on the pole using a cable within the pole that is attached at one end to the top of the flag mast, and at the other end, to a capstan located near the base of the pole. A hand crank, ratchet and pawl mechanism allows the capstan to be rotated, thereby manually raising or lowering the flag. A powered means can also be employed to raise or lower the flag, such as winch in place of the capstan and hand crank.

An object of the invention is to provide an apparatus which provides constant illumination to a flag hanging therefrom.

Another object of the invention is to provide an apparatus which illuminates a flag hanging therefrom using internal light reflected onto the flag.

Another object of the invention is to provide an apparatus which automatically illuminates a flag hanging therefrom at the onset of darkness.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Referring more specifically to the drawings, for illustrative purposes the present invention is embodied in the apparatus generally shown in FIG. 1 through FIG. 10 It will be appreciated that the apparatus may vary as to configuration and as to details of the parts without departing from the basic concepts as disclosed herein.

Figure 1:
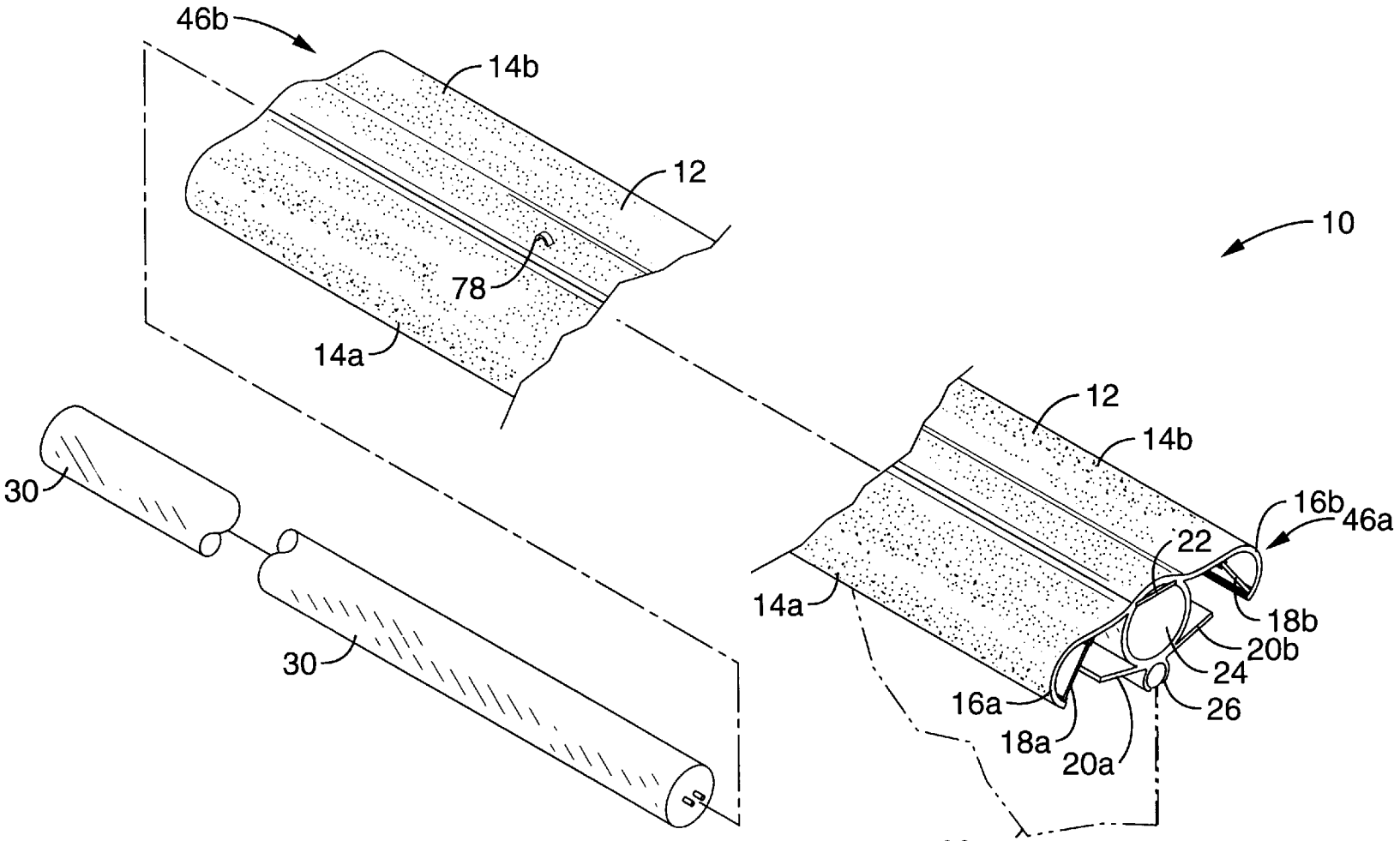
FIG. 1 is a fragmentary perspective view of the flag mast apparatus in accordance with the present invention showing a portion of a flag in phantom and showing the light source removed.
Figure 2:
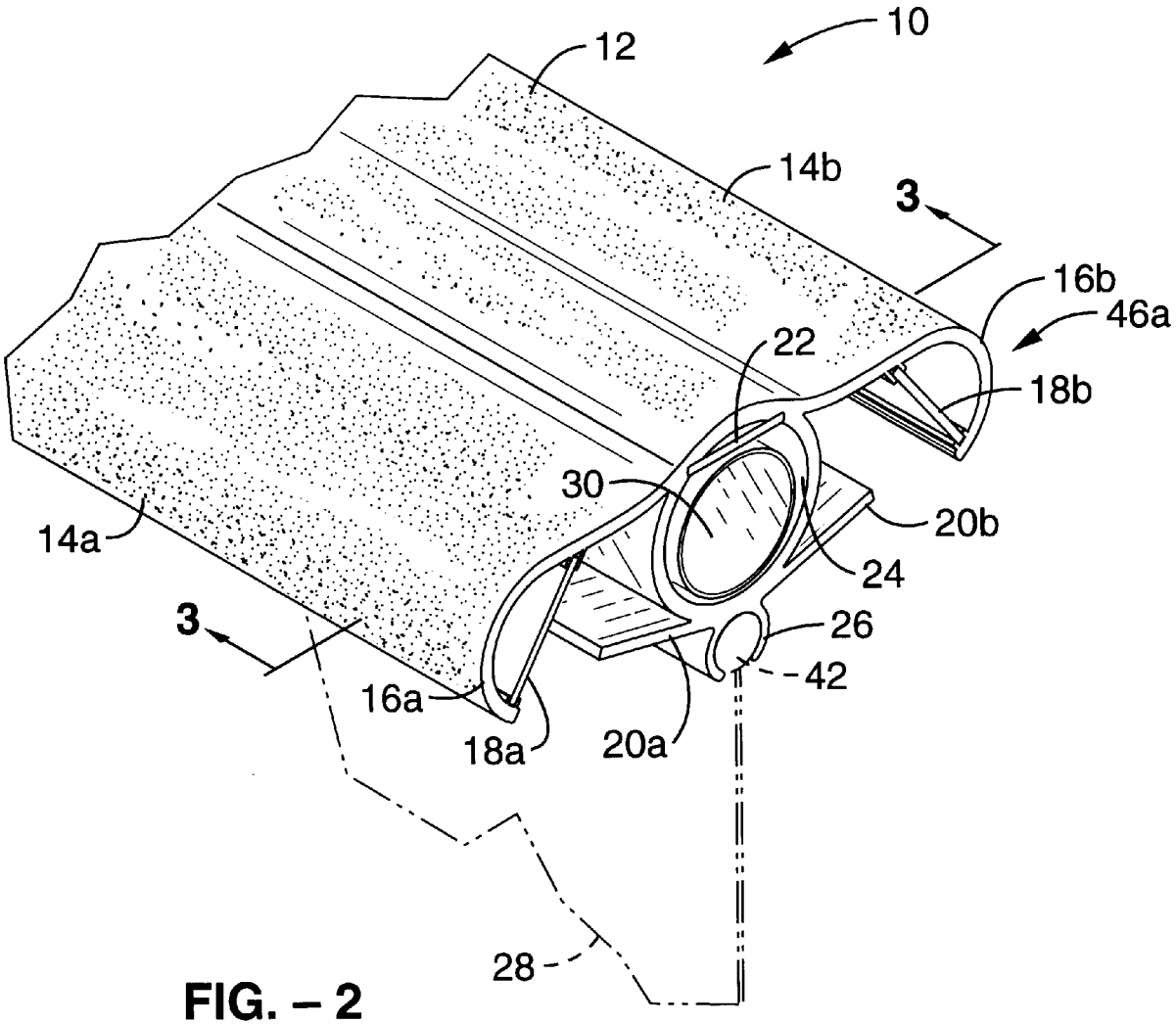
FIG. 2 is a fragmentary perspective view of the flag mast apparatus as shown in FIG. 1 with the light source shown in its assembled position.
Figure 3:
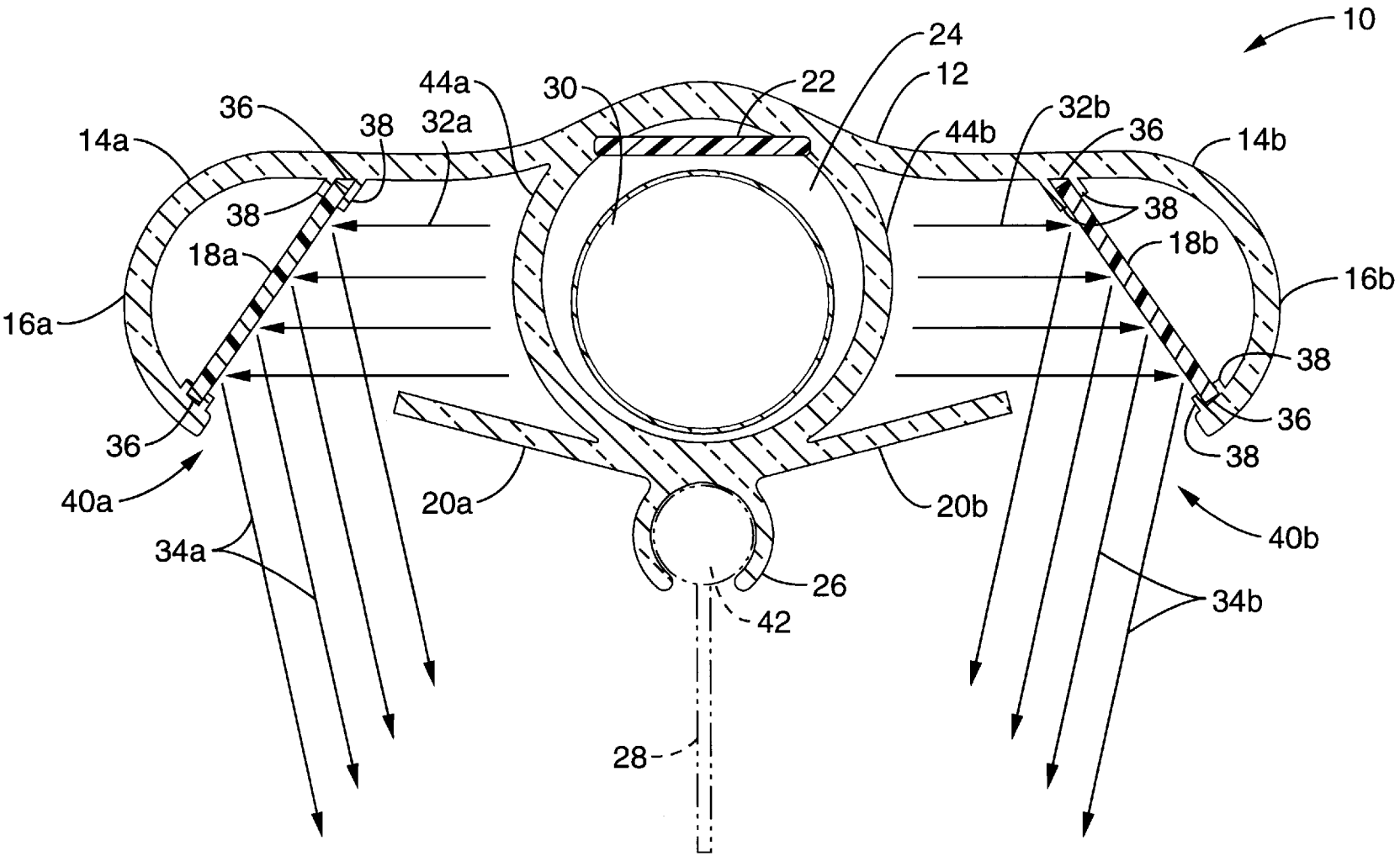
FIG. 3 is a cross-sectional view of the apparatus shown in FIG. 2 taken along line 3—3.

Referring first to FIG. 1 through FIG. 3, an internally lighted flag mast 10 in accordance with the preferred embodiment of the present invention is generally shown. As will be seen, flag mast 10 generally comprises an elongated cover 12, a pair of sides 14*a,b* terminating with curved edges 16*a,b,* reflectors 18*a,b,* baffles 20*a,b,* a mounting strip 22, a light mount 24 and a flag holder 26. Flag mast 10 is configured such that the top edge of a flag 28 can be attached horizontally along flag mast 10 using flag holder 26 and flown in a downwardly depending position.

Elongated cover 12 extends at least the entire width of flag 28 and has sides 14*a,b* extending outwardly therefrom. Each of sides 14*a,b* terminate with downwardly curved edges 16*a,b* which serve to block light emanating from a light source 30 within light mount 24 as well as to facilitate the mounting of reflectors 18*a,b* therein. Preferably, light source 30 is a fluorescent-type bulb such as a 15 watt T-8 bulb or the like, that extends approximately the entire width of flag 28. Alternatively, multiple bulbs could be used for light source 30. Further, instead of using a fluorescent light source, other types of light sources could be used, including incandescent sources, solid state sources, fiber optics and the like. An example of a fiber optic material that could be used is Lumenyte, which is a commercially available product comprising a high output light source that transmits light through a translucent tube. This product is effective at long lengths and can be produced in various diameters. It is also well suited to operation in an embodiment using batteries that are recharged by photovoltaic cells.

Reflectors 18*a,b* also extend approximately the entire width of flag 28 and can be of a single linear strip or a series of sections arranged linearly. In the preferred embodiment, each reflector 18*a,b* is a single linear strip located within each curved edge 16*a,b* and extends parallel to light source 30. Reflectors 18*a,b* are oriented such that direct light 32*a,b* emanating from light source 30 strikes each reflector 18*a,b* which then directs reflected light 34*a,b* downward and away from apparatus 10 and toward flag 28 hanging therefrom. Reflectors 18*a,b* are preferably fixedly mounted within curved edges 16*a,b* into slots 36 formed between tabs 38 protruding within curved edges 16*a,b* or adjustably mounted using end pivots (not shown). Reflectors 18*a,b* can be acrylic strips covered with reflective paint, chrome-plated metal strips, mirrored strips, or the like.

A pair of baffles 20*a,b* are located below light source 30, and baffles 20*a,b* extend at least the entire length of the light source 30. Baffles 20*a,b* are essentially linear strips that are arranged such that they prevent direct (unreflected) light 32*a,b* from light source 30 from shining down and out of flag mast 10. Baffles 20*a,b* are wide enough to accomplish said objective but do not block any reflected light 34*a,b* from shining down and out of flag mast 10. An opening or gap 40*a,b* exists between each baffle 20*a,b* and each corresponding curved edge 16*a,b* and extends the length of each baffle 20*a,b* and curved edge 16*a, b,* respectively. It is through gaps 40*a,b* by which reflected light 34*a,b* exits flag mast 10 to illuminate flag 28.

Mounting strip 22 located within light mount 24 allows the mounting of electrical components (not shown) thereon necessary for operating light source 30. For example, where a fluorescent light source is used, mounting strip 22 could be used to mount a ballast, fuse, associated wiring and the like.

Flag holder 26 is located generally beneath light source 30 and between baffles 20*a,b.* Flag holder 26 can be of any known configuration and as illustrated, comprises a dowel rod holder into which a dowel rod 42 of flag 28 is inserted to display flag 28. Preferably, the flag 28 being displayed has a bottom hem (not shown) to allow for insertion of a weight, such as a rod, so that both sides of flag 28 are flat and reflected light 34*a,b* can completely illuminate the surfaces of flag 28.

In the preferred embodiment, flag mast 10 is fabricated from a one-piece transparent section of plastic or like synthetic material which is extruded to form elongated cover 12, sides 14*a,b,* curved edges 16*a,b,* baffles 18*a,b,* light mount 24 and flag holder 26. The one-piece extruded section is rendered mostly opaque by mask painting elongated cover 12, sides 14*a,b,* curved edges 16*a,b,* and baffles 18*a,b,* thereby preventing the passage of direct light 32*a,b* or reflected light 34*a,b* therethrough. The surfaces 44*a,b* of light mount 24 directly facing reflectors 18*a,b* are left transparent, however, to form a pair of "lenses" adjacent and juxtaposed light source 30 whereby direct light 32*a,b* from light source 30 can pass through to reflectors 18*a,b.* As such, light mount 24 forms an enclosure for light source 30 thereby preventing contamination or moisture from entering light mount 24. Flag mast 10 can also be fabricated from extruded aluminum having a top extrusion, a bottom extrusion with "lenses" that either slide or snap in place, thereby providing a sealed enclosure for light source 30.

Figure 4:
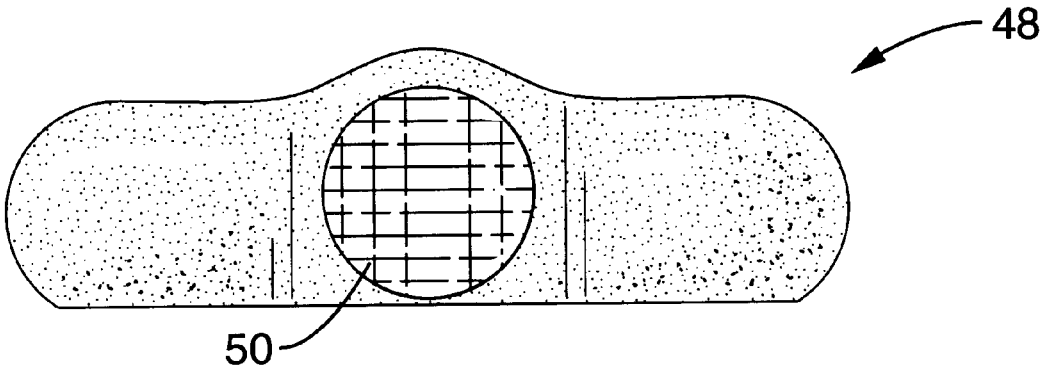
FIG. 4 is a front elevational view of an end cap in accordance with the present invention.
Figure 5:
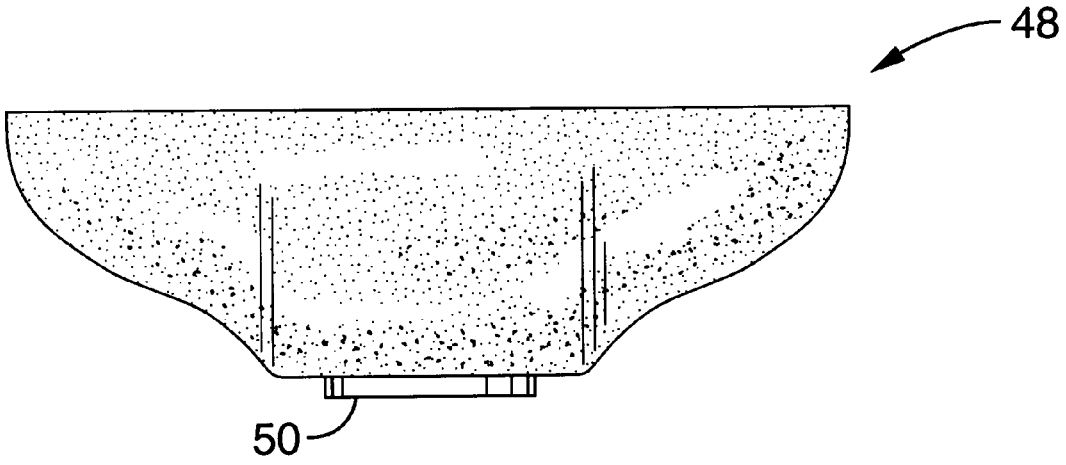
FIG. 5 is a top plan view of the end cap shown in FIG. 4.

Referring to FIG. 4 and FIG. 5 as well as to FIG. 1, flag mast 10, having a distal end 46*a* and proximate end 46*b*, uses a front end cap 48 to cover the distal end 46*a* of flag mast 10. Front end cap 48, which is fitted over distal end 46 to seal light source 30, preferably has a light sensor 50 that automatically triggers activation of light source 30 during darkness. An identical rear end cap (not shown) is placed over the proximal end 46*b* to seal that end of the apparatus.

Figure 6A:
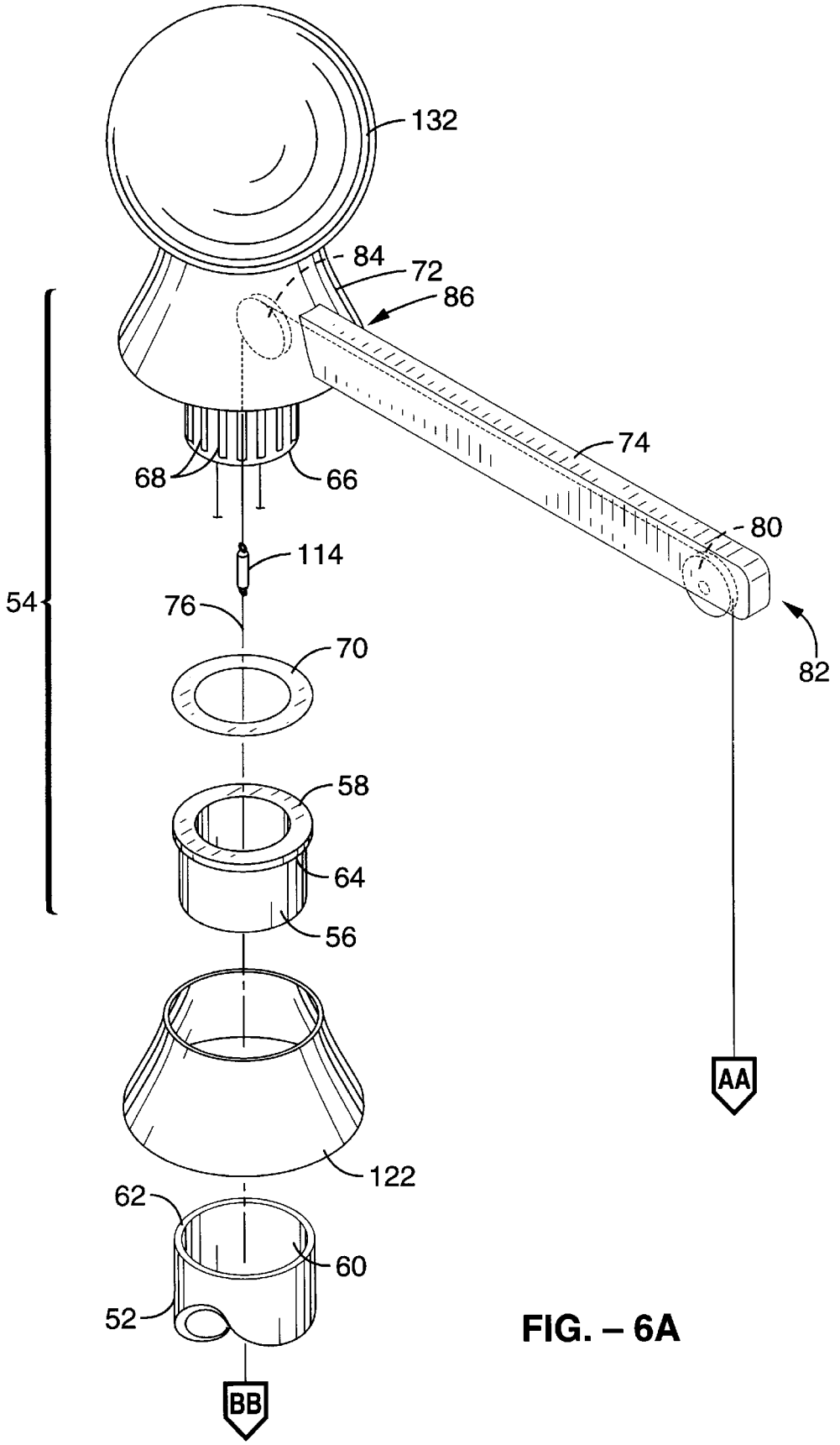
FIG. 6A and FIG. 6B are exploded views of a flagpole pivot assembly in accordance with the present invention.
Figure 6B:
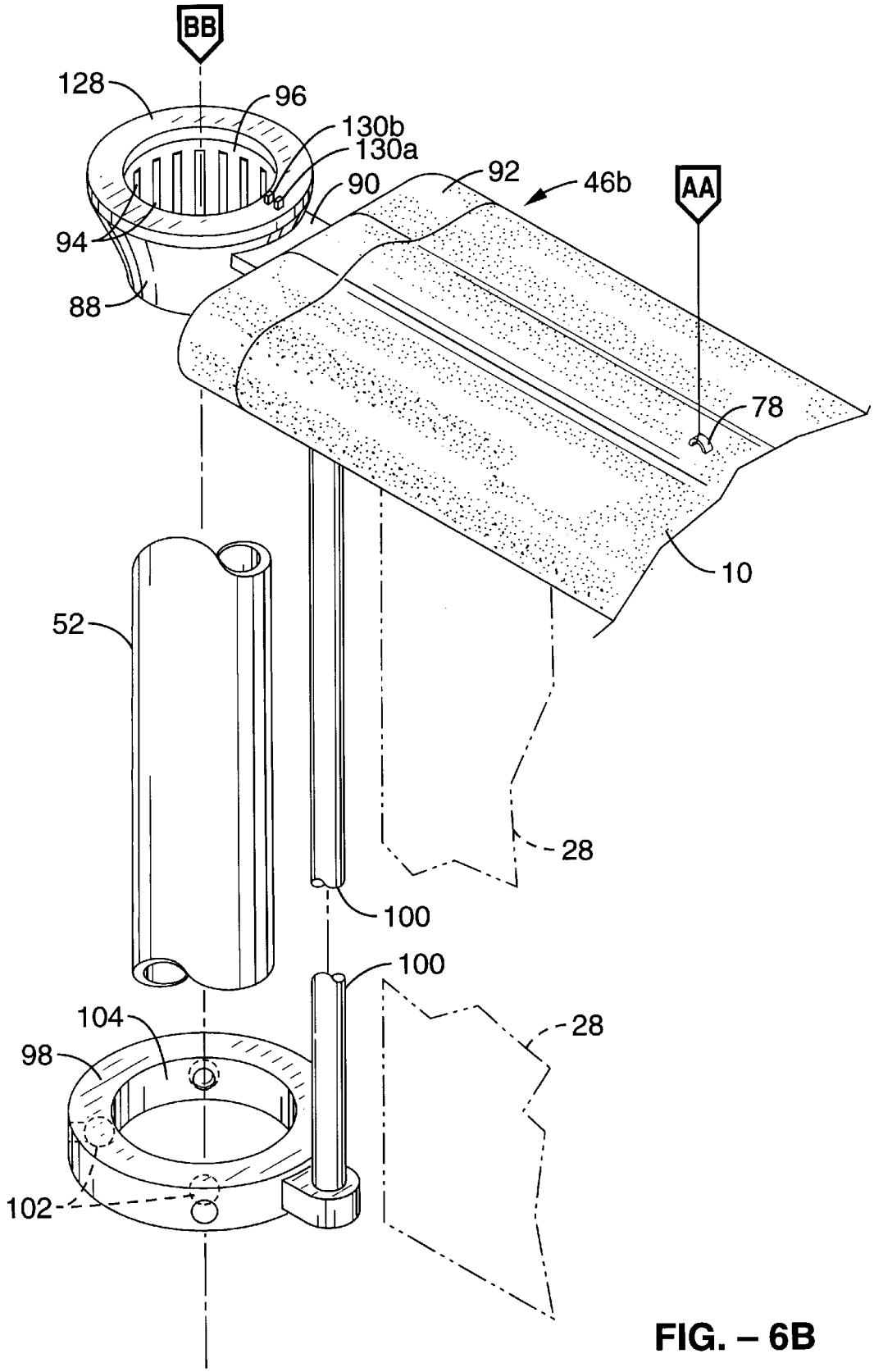

Referring also to FIG. 6A and FIG. 6B, flag mast 10 can be combined with a flag pole 52 for support in a manner such that it is capable of revolving about flag pole 52 to conform with changes in wind direction. A pivot assembly 54 allows 360° revolution of flag mast 10 around flag pole 52. Pivot assembly 54 preferably comprises a bearing collar 56 having a flat upper bearing surface 58. Bearing collar 56 is generally circular and adapted to fit within a hollow bore 60 of flag pole 52 adjacent the top 62 of flag pole 52. Beneath upper bearing surface 58 is an annular flange 64 which prevents bearing collar 56 from slipping into hollow bore 60, as annular flange 64 rests on top 62 of flag pole 52. A cylindrical bearing sleeve 66 is adapted to fit within bearing collar 56. Roller bearings 68 around the circumference of bearing sleeve 66 allow for virtually frictionless rotation of bearing sleeve 66 within bearing collar 56. A washer 70 disposed between upper bearing surface 58 of bearing collar 56 and an upper thrust bearing race 72 on bearing sleeve 66 serve to evenly distribute the compressive load of flag mast 10 throughout upper bearing surface 58. A boom arm 74 is fixedly attached to upper thrust bearing race 72 such that revolving movement of boom arm 74 about the longitudinal axis of flag pole 52 causes a corresponding rotational movement of bearing sleeve 66.

A cable 76 is situated within hollow bore 60 whereby flag mast 10 can be either raised or lowered by cable 76 retracting into hollow bore 60 or extending from hollow bore 60, respectively. Cable 76 is attached at one end to a lift eye 78 on flag mast 10 and is guided around a first pivot 80 adjacent distal end 82 of boom arm 74, to a second pivot 84 adjacent the proximate end 86 of boom arm 74 and into hollow bore 60 of flag pole 52.

Flag mast 10 is fixedly attached to a pivot collar 88 by a pole adapter 90 on a rear end cap 92 fitted over proximate end 46*b* of flag mast 10. Rear end cap 90 accepts a 1½ inch support tube or socket adapter. Pivot collar 88 provides both revolving movement and longitudinal movement capability to flag mast 10 relative to flag pole 52. Pivot collar 88 has an annular shape and slidably engages around flag pole 52. Bearings 94 on the inner surface 96 of pivot collar 88 run adjacent to flag pole 52 surface and provide for relatively frictionless movement of pivot collar 88 along flag pole 52. A pole follower 98 is located below and apart from pivot collar 88. Pole follower 98 is connected to pivot collar 88 by a spacer bar 100 which causes pole follower 98 to move longitudinally and rotatably along with pivot collar 88. Pole follower 98 has spring loaded ball bearings 102 on its inner surface 104 which compensates for taper of flag pole 52 as flag mast 10 is raised or lowered.

Figure 7:
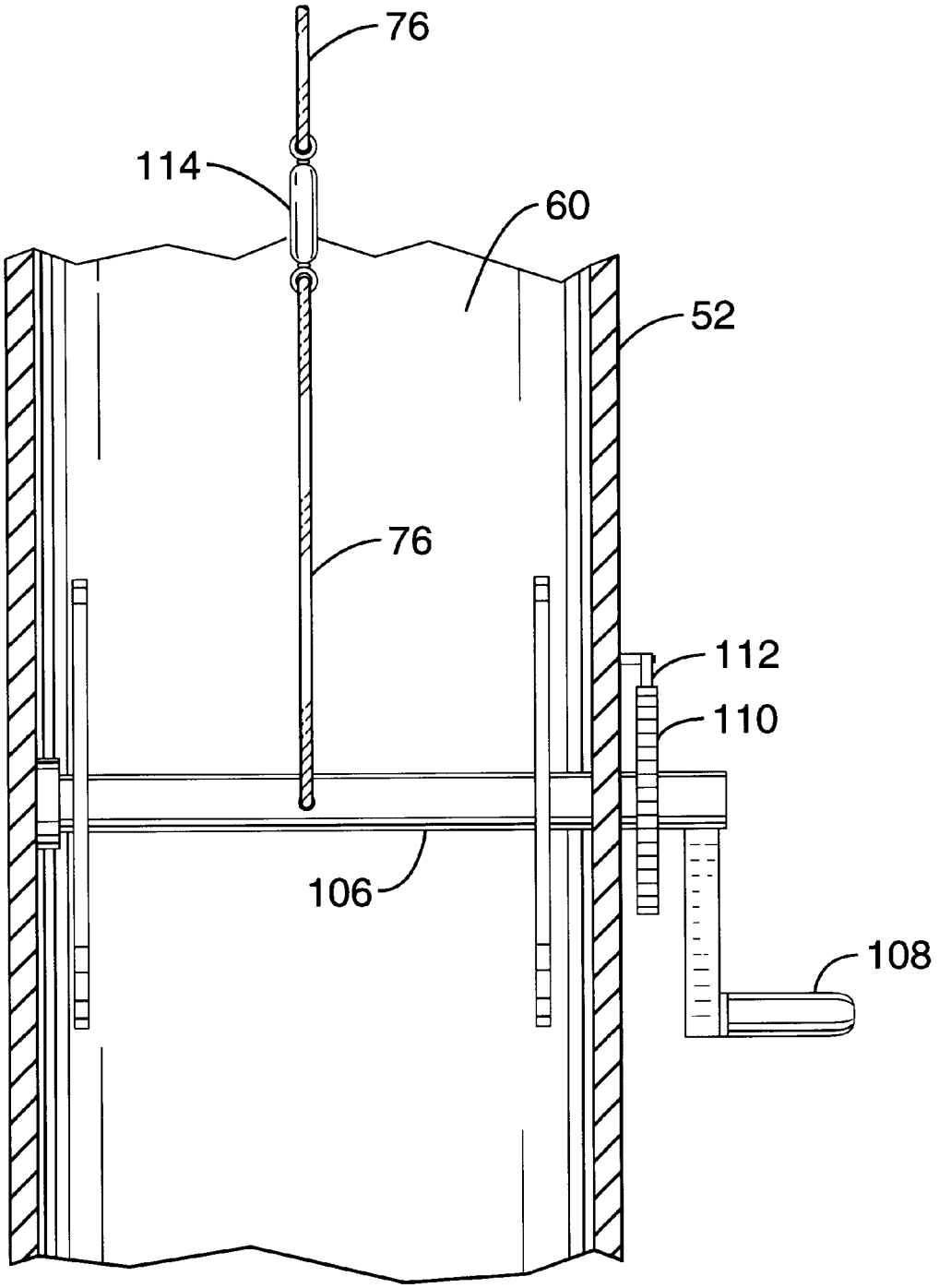
FIG. 7 is cutaway side elevational view of the cable and drum portion of a raising and lowering mechanism in accordance with the present invention.
Figure 8:
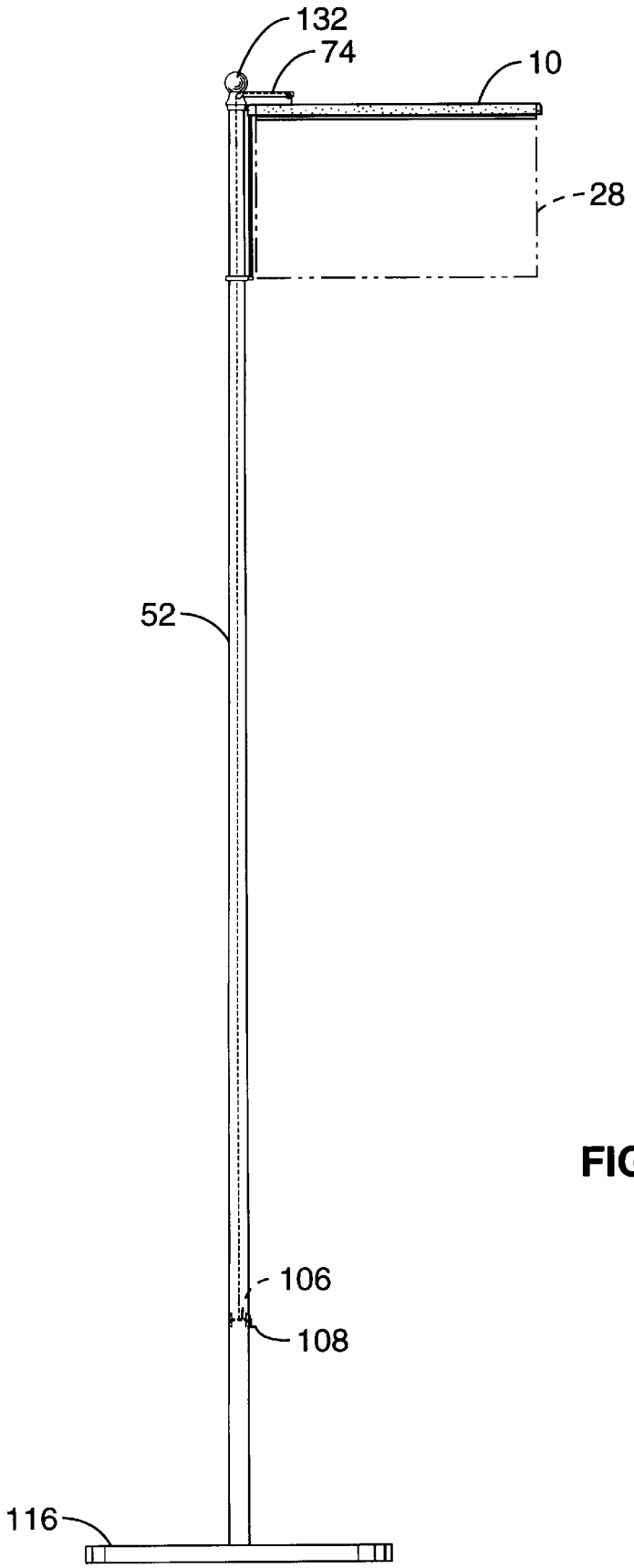
FIG. 8 is a side elevational view of the apparatus shown in FIG. 1 attached to a flagpole in accordance with the present invention.

FIG. 7 and FIG. 8 show that the other end of cable 76 is attached to a drum 106 which is capable of coiling cable 76 when rotated. Affixed at one end of drum 106 is a handle 108 by which drum 106 can be manually rotated. A ratchet gear 110 and pawl 112 mechanism locks drum 106 in a specified position when flag mast 10 and flag 28 is in a raised position and prevents flag mast 10 from inadvertently lowering due to the weight of flag mast 10. To compensate for twisting in cable 76 during motion, cable swivels 114 are placed at intervals along the length of cable 76 to allow 360° cable 76 rotation. As an option, a powered means (not shown) to raise or lower flag mast 10 can be adapted to flag pole 52, whereby an electrically powered winch replaces drum 106, handle 108, ratchet gear 1 10 and pawl 112. A switch (not shown) controlling the winch can either be placed adjacent the base 116 of flag pole 52 or at a remote location.

Figure 9:
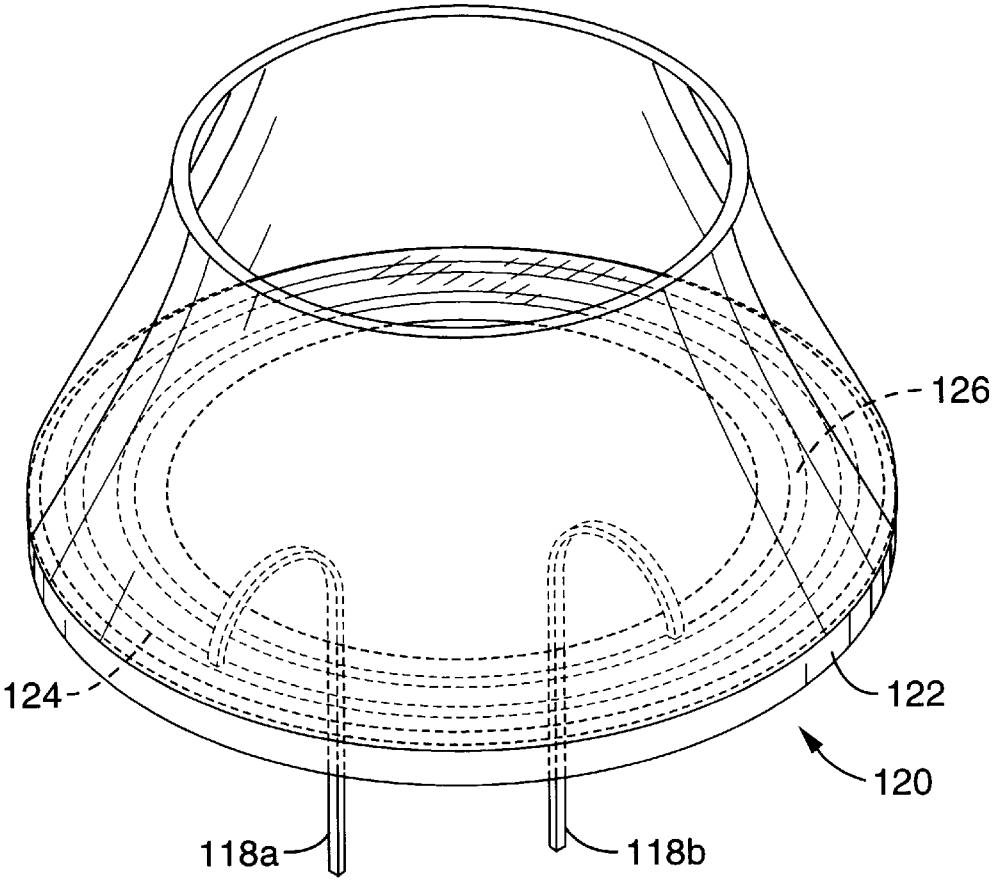
FIG. 9 is a perspective view of a power transfer collar in accordance with the present invention.
Figure 10:
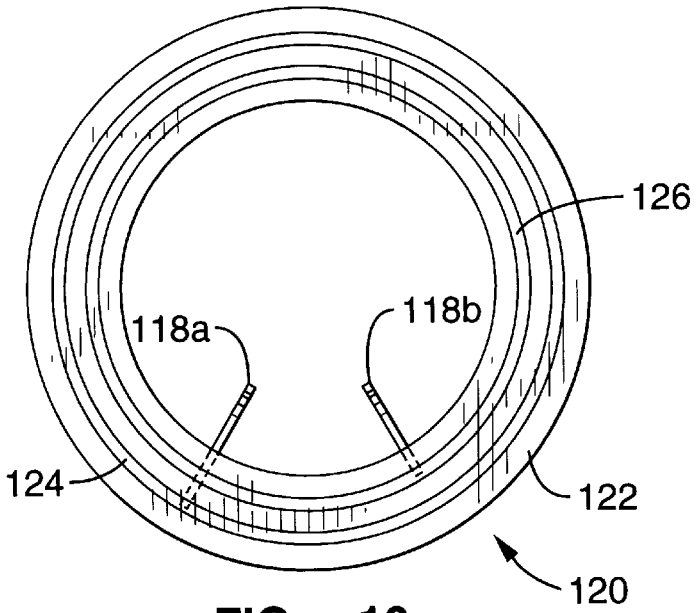
FIG. 10 is a bottom view of the power transfer collar shown in FIG. 9.

Referring additionally to FIG. 9 and FIG. 10, where light source 30 is not powered by rechargeable batteries or other integral power source, electrical power is provided to light source 30 via lead wires 118*a,b* running up through hollow bore 60 to a power transfer collar 120, which is positioned inside of upper thrust bearing race 72 and affixed around flag pole 52. Lead wire 118*a* is connected to one leg of an electrical power source (not shown), and lead wire 118*b* is connected to the other leg of the electrical power source. Power transfer collar 120 remains stationary even when flag mast 10 is raising, lowering or revolving. Power transfer collar 120 has a flat lower circular section 122 that circumscribes flag pole 52. Located on circular section 122 are a pair of concentric power pickup rings 124, 126 of a conductive material, such as brass. Outer power pickup ring 124 is in electrical contact with lead wire 118*a* and an inner power pickup ring 126 is in electrical contact with lead wire 118*b*.

When flag mast 10 is raised to its uppermost position as shown in FIG. 8, the upper surface 128 of pivot collar 88 mates with lower circular section 122 of power transfer collar 120. A pair of spring-loaded power pickup brushes 130*a,b* are located on upper surface 128 of pivot collar 88. One spring-loaded power pickup brush 130*a* lines up with outer circular conductive ring 124 and the other spring-loaded power pickup brush 130*b* lines up with inner circular conductive ring 126, thus maintaining continuous conductivity between power transfer collar 120 and pivot collar 88 even while pivot collar 88 is rotating. Power pickup brushes 130*a,b* are electrically connected to light source 30 and light sensor 50. A decorative ornament 132 can be placed atop flag pole 52, and can include an additional light source if desired.

As indicated previously, light source 30 can optionally be powered by a rechargeable battery (not shown) that recharges using energy from sunlight captured by photovoltaic cells (not shown). A plurality of photovoltaic cells can be arranged atop the elongated cover 12, thereby resulting in a independently powered light source without the need for electrical power being delivered from an external source.

As an alternative, an internally lighted mast can also be disposed below a flag such that the flag is illuminated with reflected light both from above and below the flag. The flag can also be illuminated from below using a single internally lighted mast disposed below the flag instead of from above as previously described. In such a configuration, the flag is suspended using a support cable above the flag.

Accordingly, it will be seen that this invention provides consistent and uniform illumination to a flag hanging therefrom using controlled, calculated and specifically directed reflected light from an internal light source, without the annoying glare from direct light generally associated with illuminated flag poles. Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. An internally lighted flag mast apparatus, comprising:

(a) an elongated flag mast, said flag mast including a flag holder, said flag mast including a reflector assembly;

(b) a light source positioned in said flag mast between said flag holder and said reflector assembly; and (c) a baffle positioned in said flag mast between said flag holder and said light source wherein said baffle blocks light emitted from said light source that would directly illuminate a flag held by said flag holder so that reflected light will be selectively directed toward and illuminate the flag.

2. An apparatus as recited in claim 1, wherein said flag mast includes:

(a) an elongated cover, said cover including a first arcuate side member, a second arcuate side member, a proximate end and a distal end, said first side member and said second side member extending outwardly from said cover, said first side member and said second side member each terminating in downwardly curved edges;

(b) a first end cap and a second end cap, said first end cap fitted over said proximate end of said cover, said second end cap fitted over said distal end of said cover;

(c) a mounting strip generally disposed beneath said cover, said mounting strip adapted to hold lighting components; and (d) a light source support member positioned longitudinally beneath said cover and generally between said curved edges of said cover (e) wherein said flag holder is attached to said light source support member.

3. An apparatus as recited in claim 2, wherein said baffle comprises:

(a) a first and a second opaque strip;

(b) wherein said first opaque strip is attached to said light source support member between said light source support member and said flag holder and disposed generally parallel to said light mounting means, said first opaque strip extending towards said first curved edge of said cover; and (c) wherein said second opaque strip is attached to said light source support member between said light source support member and said flag holder and disposed generally parallel to said light mounting means, said second opaque strip extending towards said second curved edge of said cover.

4. An apparatus as recited in claim 2, wherein said reflector assembly comprises:

(a) a first reflective strip attached within said first arcuate side member of said cover wherein said first strip is in direct light communication with said light source; and (b) a second reflective strip attached within said second arcuate side member of said cover wherein said second strip is in direct light communication with said light source.

5. An apparatus as recited in claim 2, wherein said elongated cover, said first arcuate side member, said second arcuate side member, said baffle, said light source support member and said flag holder comprise a one-piece extruded plastic section, and wherein said elongated cover, said first arcuate side member and said second arcuate side member are coated with an opaque paint.

6. An apparatus as recited in claim 1, further comprising an automatic light activation means for automatically activating said light source during darkness.

7. An apparatus as recited in claim 1, further comprising:

(a) a vertical pole, said pole including a hollow bore extending therethrough longitudinally, said pole including a top and a base;

(b) pivot means for rotating said flag mast on said vertical pole;

(c) means to raise and lower said flag mast on said vertical pole; and (d) a power transfer collar located adjacent said top of said pole, said power collar capable of transferring electrical power from an external source to said light source.

8. An apparatus as recited in claim 7, wherein said pivot means comprises:

(a) a circular bearing collar adapted to fit into said top of said vertical pole, said bearing collar including a flat upper surface;

(b) a bearing sleeve rotatably engaged within said bearing collar, said bearing sleeve including a plurality of roller bearings disposed circumferentially around said bearing sleeve;

(c) a washer disposed between said bearing collar and said bearing sleeve;

(d) an upper thrust bearing race fixedly attached to said bearing sleeve; and (e) a boom arm located fixedly attached to said bearing sleeve, said boom arm including a proximate end and a distal end.

9. An apparatus as recited in claim 8, wherein said means to raise and lower said flag mast comprises:

(a) a pivot collar slidably engaged around said pole, wherein said flag mast is attached to said upper collar;

(b) a pole follower slidably engaged around said pole, said pole follower positioned below and spaced apart from said pivot collar;

(c) a support bar connecting said pole follower to said pivot collar;

(d) a first pulley and a second pulley, said first pulley located adjacent said proximate end of said boom arm, said second pulley located adjacent said distal end of said boom arm;

(e) a capstan assembly position adjacent said base of said pole;

(f) a cable attached at one end to said flag mast, said cable attached at another end to said capstan assembly whereby rotating said capstan assembly causes said cable to coil around said capstan, said cable extending through said bore of said pole, said cable extending around said first pulley and said second pulley; and (g) capstan rotating means capable of extending and retracting said cable whereby said flag mast is lowered and raised, respectively.

10. An internally lighted flag mast apparatus, comprising:

(a) an elongated cover, said cover including a first arcuate side member, a second arcuate side member, a proximate end and a distal end, said first side member and said second side member extending outwardly from said cover, said first side member and said second side member each terminating in downwardly curved edges;

(b) a first end cap and a second end cap, said first end cap fitted over said proximate end, said second end cap fitted over said distal end;

(c) a light source holder disposed longitudinally beneath said cover and generally between said side members;

(d) a light source mounted in said light source holder;

(e) a reflector assembly located between said curved edges of said cover;

(f) a flag holder;

a baffle positioned in said flag mast between said flag holder and said light source wherein said baffle blocks light emitted from said light source that would directly illuminate a flag held by said flag holder so that reflected light will be selectively directed toward and illuminate the flag; and (h) light activation means for automatically activating said light source during darkness, said light activation means housed within said second cap.

11. An apparatus as recited in claim 10, wherein said elongated cover, said baffle and said flag holder comprise a one-piece extruded plastic section, and wherein said elongated cover, said first side member and said second side member are coated with an opaque paint.

12. An apparatus as recited in claim 10, wherein said baffle comprises:

(a) a first and a second opaque strip;

(b) wherein said first opaque strip is attached beneath said light source holder, said first opaque strip extending from beneath said light source holder towards said first curved edge of said cover; and (c) wherein said second opaque strip is attached beneath said light source holder, said second opaque strip extending from beneath said light source holder towards said second curved edge of said cover.

13. An apparatus as recited in claim 10, wherein said reflector assembly comprises:

(a) a first reflective strip attached within said first arcuate side member of said cover, wherein said first strip is in direct light communication with said light source; and (b) a second reflective strip attached within said second arcuate side member of said cover, wherein said second strip is in direct light communication with said light source.

14. An apparatus as recited in claim 10, further comprising:

(a) a vertical pole, said pole including a bore extending therethrough longitudinally, said pole including a top and a base;

(b) pivot means for rotating said flag mast apparatus on said vertical pole;

(c) means to raise and lower said flag mast apparatus on said vertical pole; and (d) a power transfer collar located adjacent said top of said pole, said power collar capable of transferring electrical power from an external source to said light source.

15. An apparatus as recited in claim 14, wherein said pivot means comprises:

(a) a circular bearing collar adapted to fit into said top of said vertical pole, said bearing collar including a flat upper surface;

(b) a bearing sleeve rotatably engaged within said bearing collar, said bearing sleeve including a plurality of roller bearings disposed circumferentially around said bearing sleeve;

(c) a washer disposed between said bearing collar and said bearing sleeve;

(d) an upper thrust bearing race fixedly attached to said bearing sleeve; and (e) a boom arm fixedly attached to said bearing sleeve, said boom arm including a proximate end and a distal end.

16. An apparatus as recited in claim 15, wherein said means to raise and lower said flag mast apparatus comprises:

(a) an upper collar slidably engaged around said pole, said flag mast attached to said upper collar;

(b) a pole follower engaged around said pole, said pole follower positioned below and spaced apart from said upper collar;

(c) a support bar connecting said pole follower to said upper collar;

(d) a first pulley and a second pulley, said first pulley located adjacent said proximate end of said boom arm, said second pulley located adjacent said distal end of said boom arm;

(e) a capstan assembly position adjacent said base of said pole;

(f) a cable attached at one end to said flag mast, said cable attached at another end to said capstan assembly whereby rotating said capstan causes said cable to coil around said capstan, said cable extending through said bore of said pole, said cable extending around said first pulley and said second pulley; and (g) capstan rotating means capable of extending and retracting said cable whereby said flag mast apparatus is lowered and raised, respectively.

17. An internally lighted flag mast apparatus, comprising:

(a) an elongated cover, said cover including a first side, a second side, a proximate end and a distal end, said first side and said second side extending outwardly from said cover, said first side and said second side each terminating in downwardly curved edges;

(b) a first cap and a second cap, said first cap fitted over said proximate end, said second cap fitted over said distal end;

(c) a light source disposed longitudinally beneath said cover and generally between and curved edges;

(d) a first and a second opaque strip, said first opaque strip is attached beneath said light source and disposed generally parallel to said light source, said first opaque strip extending from beneath said light source towards said first curved edge, said second opaque strip is attached beneath said light source and disposed generally parallel to said light source, said second opaque strip extending from beneath said light source towards said second curved edge;

(e) a first reflective strip and a second reflective strip, said first strip attached within said first curved edge wherein said first strip is in direct light communication with said lighting means, said first strip positioned to reflect said direct light outwardly from said flag mast, said second strip attached within said second curved edge wherein said second strip is in direct light communication with said light source, said second strip positioned to reflect said direct light outwardly from said apparatus; and (f) flag mounting means for allowing a flag to be downwardly suspended beneath said light source; and (g) light activation means for automatically activating said light source during darkness, said means housed within said second cap.

18. An apparatus as recited in claim 17, wherein said elongated cover, said first side, said second side, said light baffle means and said flag mounting means comprise a one-piece extruded plastic section, whereby said elongated cover, said first and said second sides are coated with an opaque paint.

19. An apparatus as recited in claim 17, further comprising:

(a) a vertical pole, said pole include a hollow bore extending therethrough longitudinally, said pole including a top and a base;

(b) pivot means for rotating said flag mast on said vertical pole;

(c) means to raise and lower said flag mast on said vertical pole; and (d) a power transfer collar located adjacent said top of said pole, said power collar capable of transferring electrical power from an external source to said light source.

20. An apparatus as recited in claim 19, wherein said pivot means comprises:

(a) a circular bearing collar adapted to fit into said top of said vertical pole, said bearing collar including a flat upper surface;

(b) a bearing sleeve rotatably engaged within said bearing collar, said bearing sleeve including a plurality of roller bearings disposed circumferentially around said bearing sleeve;

(c) a washer disposed between said bearing collar and said bearing sleeve;

(d) an upper thrust bearing race fixedly attached to said bearing sleeve; and (e) a boom arm located adjacent said top of said pole, said boom arm including a proximate end and a distal end.

21. An apparatus as recited in claim 20, wherein said means to raise and lower said flag mast comprises:

(a) an upper collar slidably engaged around said pole, said flag mast attached to said upper collar;

(b) a pole follower slidably engaged around said pole, said pole follower positioned below and spaced apart from said upper collar;

(c) a support bar connecting said pole follower to said upper collar;

(d) a first pulley and a second pulley, said first pulley located adjacent said proximate end of said boom arm, said second pulley located adjacent said distal end of said boom arm;

(e) a capstan assembly adjacent said base of said pole;

(f) a cable attached at one end to said cable attached at another end to said capstan assembly whereby rotating said capstan causes said cable to coil around said capstan, said cable extending through said bore of said pole, said cable extending around said first pulley and said second pulley; and (g) capstan rotating means capable of extending and retracting said cable, whereby said flag mast is lowered and raised, respectively.

22. An internally lighted flag mast apparatus, comprising:

(a) an elongated flag mast;

(b) internal lighting means in said flag mast for providing light within said flag mast;

(c) light reflector means in said flag mast for reflecting light from said internal lighting means and projecting said light outward from said flag mast in a selected pattern; and (d) light baffle means in said flag mast for preventing unreflected light from said internal lighting means from projecting outward from said flag mast;

(e) wherein said flag mast comprises (i) an elongated cover, said cover including a first side, a second side, a proximate end and a distal end, said first side and said second side extending outwardly from, said cover, said first side and said second side each terminating in downwardly curved edges, (ii) a first cap and a second cap, said first cap fitted over said proximate end, said second cap fitted over said distal end, (iii) a mounting strip generally disposed beneath said cover, said mounting strip adapted to hold lighting components, (iv) light mounting means for attachment of said internal lighting means, said light mounting means located longitudinally beneath said cover and generally between said curved edges, and (v) flag mounting means for allowing a flag to be downwardly suspended from said flag mast; and (f) wherein said light baffle means comprises (i) a first opaque strip attached beneath said light mounting means and disposed generally parallel to said light mounting means, said first opaque strip extending from beneath said light mounting means towards said first curved edge, and (ii) a second opaque strip attached beneath said light mounting means and disposed generally parallel to said light mounting means, said second opaque strip extending from beneath said light mounting means towards said second curved edge.

23. An internally lighted flag mast apparatus, comprising:

(a) an elongated cover, said cover including a first side, a second side, a proximate end and a distal end, said first side and said second side extending outwardly from said cover, said first side and said second side each terminating in downwardly curved edges;

(b) a first cap and a second cap, said first cap fitted over said proximate end, said second cap fitted over said distal end;

(c) a light source holder disposed longitudinally beneath said cover and generally between said curved edges, said mounting strip adapted to hold lighting components;

(d) a light source mounted in said light source holder;

(e) reflector means for outwardly reflecting light emitted from said light source when said light source is activated, said reflector means located continuously within each said curved edges;

(f) light baffle means for blocking outward radiation of direct light from said light source when said light source is activated, said light baffle means located longitudinally beneath said light source holder;

(g) flag mounting means for downwardly suspending a flag beneath said light source holder; and (h) light activation means for automatically activating said light source during darkness, said light activation means housed within said second cap;

(i) wherein said light baffle means comprises a first opaque strip attached beneath said light source holder, said first opaque strip extending from beneath said light source holder towards said first curved edge, and a second opaque strip attached beneath said light source holder, said second opaque strip extending from beneath said light source holder towards said second curved edge.

24. An internally lighted flag mast apparatus, comprising:

(a) an elongated flag mast, said flag mast including a cover having first and second side members extending outwardly from said cover and terminating at curved edges, said flag mast including a reflector assembly;

(b) a light source positioned beneath said cover and generally between said curved edges of said cover; and (c) a baffle comprising two opaque strips attached beneath and generally parallel to the light source and extending outward from the light source toward the edges of the cover leaving a pair of longitudinal gaps between the edges of the cover and edges of the opaque strips.

* * * * *